United States Patent [19]

Marzetta

[11] 4,009,704

[45] Mar. 1, 1977

[54] COOL-TOUCH COOKING SURFACES

[75] Inventor: Louis A. Marzetta, Gaithersburg, Md.

[73] Assignee: The United States of America as represented by the Secretary of Commerce, Washington, D.C.

[22] Filed: Aug. 17, 1976

[21] Appl. No.: 715,026

Related U.S. Application Data

[62] Division of Ser. No. 544,600, Jan. 27, 1975, abandoned.

[52] U.S. Cl. ..... 126/221; 126/39 H

[51] Int. Cl.[2] ..... F24C 15/10

[58] Field of Search ..... 126/39 M, 39 H, 221

[56] References Cited

UNITED STATES PATENTS

| | | | |
|---|---|---|---|
| 504,156 | 8/1893 | Fletcher | 126/221 |
| 689,182 | 12/1901 | Haw | 126/221 |
| 1,007,700 | 11/1911 | Irey | 126/221 X |
| 1,356,735 | 10/1920 | Parkhurst | 126/221 |
| 2,035,970 | 3/1936 | MacIldowie | 126/221 X |
| 2,054,687 | 9/1936 | Weiland et al. | 126/221 |

*Primary Examiner*—Edward G. Favors
*Attorney, Agent, or Firm*—Eugene J. Pawlikowski; Alvin J. Englert

[57] ABSTRACT

A cool-touch safety covering for the cooking surfaces of warming trays, hot plates and other cooking appliances. The covering is fibrous, springy or otherwise compressible under the weight of a pan or other cooking utensil and its contents. In the uncompressed state, the covering stores relatively little heat per unit volume and transfers the heat relatively poorly, so that it will not burn a finger or other body surface briefly contacting it, even though the covering is heated to 200°–300° C or higher. In the compressed state, the covering transfers heat relatively well, thereby permitting an ample flow of heat to the untensil and its food or other contents. In quantitative terms, the thermal inertia of the uncompressed covering should not exceed about $(T_h - 60)^{-2}$ cal²/sec-cm⁴-deg C², where $T_h$ is the maximum operating temperature of the appliance in deg C. The covering may include one or more of the following: a matted felt of asbestos, ceramic or other thermally stable fibers; a wool-like layer of ceramic, metal or other fibers; a rippled sheet of thermally stable plastic or metal; a sandwich of springs or rings between sheets of plastic or metal; or spaced-apart metal or plastic screens.

1 Claim, 6 Drawing Figures

COOL-TOUCH COOKING SURFACES

This is a division of application Ser. No. 544,600 filed Jan. 27, 1975, now abandoned.

BACKGROUND OF THE INVENTION

This invention relates to warming trays, hot plates, ranges and other cooking appliances, and more particularly to a cool-touch safety covering for the heated cooking surfaces thereof.

The operating temperatures of home cooking appliances range from about 100° C or so for warming trays to about 600° C for electric ranges at high heat. At these temperatures, the prior cooking surfaces can, as is well known, do cause serious burns to fingers, hands or other surfaces that happen to come in contact with them.

As explained in detail in my copending application Ser. No. 407,532 filed Oct. 18, 1973, for a "Thermesthesiometer," now U.S. Pat. No. 3,878,728 issued April 22, 1975 the contact temperature, $T_c$, at the interface between the skin of a finger, having a normal skin temperature, $T_p$, and the surface of a body heated to a higher temperature, $T_h$, can be expressed as $$T_c = T_h - \frac{T_h - T_p}{1 + \sqrt{\lambda_h/\lambda_p}} \quad (1)$$

where $\lambda_h$ and $\lambda_p$ are the thermal inertias of the heated body and the finger, respectively. Now, for a brief contact time in the order of a few seconds, the contact temperature should not, as explained in my application, exceed about 60° C, if thermal injury and pain are to be avoided.

Expression (1) can be rewritten as $$\lambda_h = \left(\frac{T_c - T_p}{T_h - T_c}\right)^2 \lambda_p \quad (2)$$

Using, then, the values of 60° C for $T_c$, 33° for $T_p$ and 0.0014 cal²/sec-cm⁴-deg C² for $\lambda_p$, expression (2) reduces to $$\lambda_h = (T_h - 60)^{-2} \text{ cal}^2/\text{sec-cm}^4\text{-deg C}^2 \quad (3)$$

which expresses the maximum value of the thermal inertia of the heated surface, as a function of its temperature, for a maximum allowable skin contact temperature of 60° C. For thermal safety, then, the thermal inertias of cooking or other hot surfaces should be decreased for increased operating temperature, in accordance with expression (3).

Materials of low thermal inertias, however, tend to be more like thermal insulators than thermal conductors. This is because thermal inertia is by definition the product of three terms—thermal conductivity, specific heat, and density—of which thermal conductivity is of greatest influence. Wood, plastic and other low thermal inertia materials are generally poor heat conductors, while metals and other high thermal inertia materials are good heat conductors.

Since a cooking surface must rapidly absorb heat from a heating element and transfer it to a cooking utensil, the prior surfaces have been constructed exclusively from high-conductivity materials, with attendant high thermal inertias and extremely high burn hazards.

SUMMARY OF THE INVENTION

The present invention provides a low thermal inertia, cool-touch, safety covering for a cooking surface. To obtain a reasonably high thermal conductivity along with the desired low thermal inertia, the covering is constructed from a moderately or highly heat-conducting material that is effectively divided up and spaced apart so that it is compressible under the weight of the usual cooking utensil and its liquid or solid contents. In the compressed or compacted state, the material is a moderate-to-good heat conductor. In the uncompressed, loosely contacting state, the thermal conductivity and the effective density (g/cm³) of the material are both greatly reduced, providing the desired low thermal inertia.

DETAILED DESCRIPTION OF THE INVENTION

Figure 1:
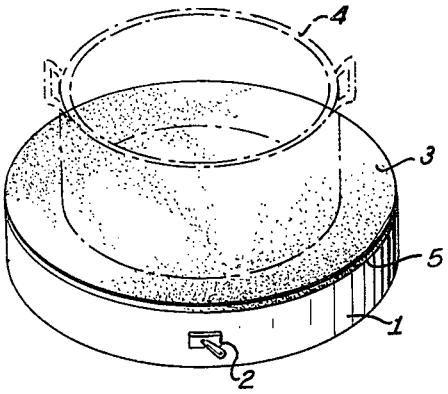
FIG. 1 is a perspective view of a hot plate provided with the cool-touch safety covering of this invention.

FIG. 1 shows a conventional cooking appliance such as a hot plate 1 with a heated cooking surface 5 which has been made safe for brief human contact by means of a cool-touch safety covering 3 constructed according to this invention. The heated surface 5 is fabricated from steel or other highly thermally conducting, thermally stable material, and it is heated by means of a conventional heating element (not shown) in good thermal contact with the underside thereof. The power to the heating element is regulated with a switch 2 or other control means, causing the heated surface 5 to assume an elevated temperature which, depending on the appliance, may go as high as, say, 300° C. An accidental contact of human skin with the steel surface 5 at this temperature would, of course, result in a severe burn—even though the human reflexes would quickly withdraw the skin in one second or less.

The thermal hazard of the hot surface 5 can be evaluated with the aid of expression (1). Let $T_h = 300°$ C
$T_p = 33°$ C (normal skin temperature)
$\lambda_h = 0.093$ cal²/sec-cm⁴-deg C² (for steel)
$\lambda_p = 0.0014$ cal²/sec-cm⁴-deg C² (for skin)

The temperature at the steel-skin interface, $T_c$, is then 270° C, which is well above the 60° C maximum permissible contact temperature for brief contact times of a few seconds or so.

Expression (3) yields the maximum safe thermal inertia, $\lambda_h$, for a surface at 300° C; namely, 0.000017 cal²/sec-cm⁴-deg C². Thus the thermal inertia of the heated steel surface should be reduced by a factor of 0.093/0.000017 or about 5500 in order to render the surface safe for brief human contact.

In accordance with this invention, the cool-touch safety covering 3, which is also heated to 300° C in this example, is constructed to have the desired low thermal inertia. A material of moderate-to-good thermal conductivity and good thermal stability, such as asbestos, ceramic, certain high-temperature plastics such as Teflon or Kapton, or metals, is selected and formed into an expanded, compressible, layer-like structure.

The safety covering 3 of FIG. 1 could thus comprise, for example, a matted felt layer of asbestos, ceramic or glass fibers or wool-like layer of ceramic or metal fibers. The felt or wool should be expanded or fluffed so that the heat stored per unit volume is relatively low and so that the heat conduction paths through the layer are relatively poor due to poor thermal contacts between adjacent fibers. The resulting low effective thermal conductivity (cal/sec-cm-deg C) and low density (g/cm$^3$), along with the specific heat of the material (cal/g-deg C), yield the desired low thermal inertia.

When the safety covering 3 of FIG. 1 is compressed by the weight of a pot 4 or other cooking utensil and its contents, the conduction paths through the covering are materially increased by the now-intimate thermal contacts between compressed fibers. Consequently, heat flows readily from the heated surface 5 to the utensil 4 and its contents. It has been found that the heat flow rate is generally reduced less than about 25% over the prior surfaces, so that a quantity of water that ordinarily might require 17 min, for instance, to bring to a boil will now require about 21 min.

The felt-like or wool-like cool-touch covering 3 shown in FIG. 1 may, if desired, be covered with one or more sheets of plastic, thin metal, or other fluid-impervious, thermally stable material to prevent absorption of spilled foods and to assist in cleaning the covering.

Figure 2:
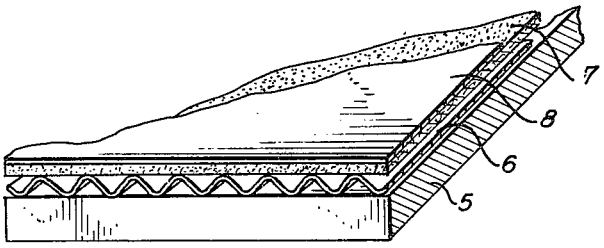
FIGS. 2, 3 and 6 are perspective views of portions of three illustrative constructions of the safety covering.

FIG. 2 shows a layer of felted fibers 7 sandwiched between a rippled or wavy sheet 6 and a flat sheet 8 of plastic or metal. The bottom rippled sheet is disposed on the heated surface 5 of a cooking appliance. In the uncompressed state, the rippled sheet 6 is characterized by relatively poor thermal contacts with the heated surface 5 and the felted fibers 7 and by a low effective density, thereby lowering the thermal inertia and burn hazard of the composite covering.

Figure 3:
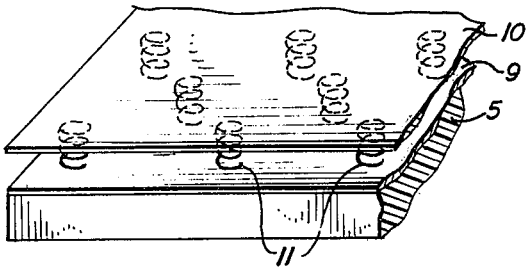

FIG. 3 shows an alternative sandwich structure comprising a plurality of coil springs between a pair of thin sheets 9 and 10. This covering also has a low thermal conductivity and low density in the uncompressed state. Compressed by a cooking utensil, the covering readily transmits heat from the heated surface 5 to the utensil and its contents.

Figure 6:
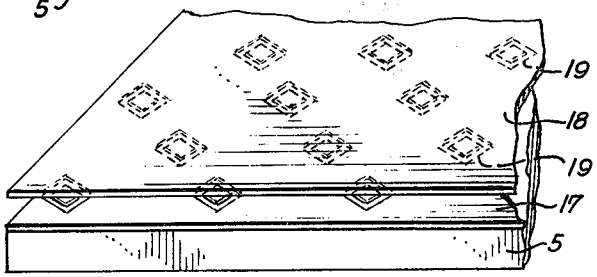

FIG. 6 shows a structure similar to that illustrated in FIG. 3, except that the coil springs have been replaced by diamond-shaped, high-compliance rings 19, disposed between sheets 17 and 18. It will be clear, therefore, that a wide variety of springs or spring-like elements could be employed in the practice of this invention. Likewise, it will be obvious to those skilled in the art that the springs can be secured to the sheets in any suitable manner and that the top and bottom sheets of the sandwich structures can be sealed along their edges to exclude moisture and foreign material and to assist in retaining the springs (or felt or wool) therein.

Figure 4:
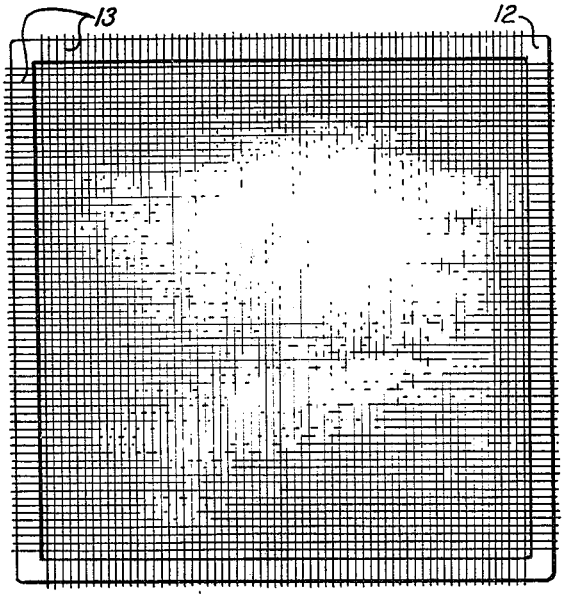
FIGS. 4 and 5 are plan and sectioned elevational views, respectively, of another illustrative construction of the covering.
Figure 5:
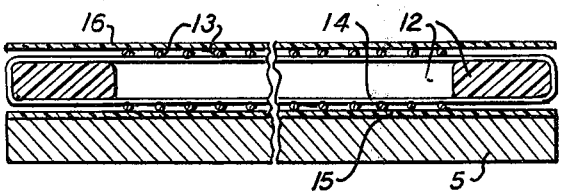

FIGS. 4 and 5 show an alternative cool-touch covering comprising a pair of spaced-apart plastic or metal screens or screen-like members 13, 14 mounted on a frame 12 and covered, if desired, by bottom and top sheets 15 and 16, respectively. In the uncompressed state, heat flows relatively poorly to the top screen and the effective density of the composite screen is relatively low. The burn hazard of the covering is thus greatly reduced.

In all of the above embodiments, the safety coverings may be simply disposed on the heated surface 5, or may be removably attached thereby by means of clips, snaps, screws or the like, or may be permanently bonded as by cementing or welding.

I claim:

1. A cool-touch covering for the heated surface of a warming tray, hot plate, or other cooking appliance, comprising:

a pair of sheets of thermally stable material which are separated by a plurality of spring-like, thermally stable elements, one of said sheets being mounted on said heated surface;

said spring-like elements being compressible under the weight of a cooking utensil and its contents to an extent sufficient to increase the thermal inertia of said sheets and elements by a factor of at least several hundred.

* * * * *